US005327837A

United States Patent [19]

Weber

[11] Patent Number: 5,327,837

[45] Date of Patent: Jul. 12, 1994

[54] BOLSTER OF A RAILROAD CAR TRUCK WITH VARYING CROSS-SECTIONAL SHAPE TO PROVIDE LESS TORSIONAL RIGIDITY AT ENDS

[75] Inventor: Hans B. Weber, Rotonda West, Fla.

[73] Assignee: National Castings Inc., Lisle, Ill.

[21] Appl. No.: 898,711

[22] Filed: Jun. 15, 1992

[51] Int. Cl.[5] ..... B61F 5/52

[52] U.S. Cl. ..... 105/226; 105/200; 105/230

[58] Field of Search ..... 105/107, 179, 200, 226, 105/227, 229, 230

[56] References Cited

U.S. PATENT DOCUMENTS

| | | | |
|---|---|---|---|
| 1,215,766 | 2/1917 | Benner | 105/226 |
| 1,407,551 | 2/1922 | Laughlin | 105/230 |
| 3,338,183 | 8/1967 | Boissier | 105/230 X |
| 3,517,620 | 6/1970 | Weber | 105/167 |
| 3,915,095 | 10/1975 | Briggs | 105/226 X |
| 4,133,268 | 1/1979 | Guillaumin | 105/226 X |

*Primary Examiner*—Mark T. Le
*Assistant Examiner*—S. Joseph Morano

[57] ABSTRACT

A bolster for a railroad car truck is described as having a generally hollow, box-like construction between its opposing ends which are transformed into I-shaped sections which are rigidly secured to the sideframes. The box-like frame provides the stiffness or rigidity necessary to resist high vertical and longitudinal loads which can cause the bolster to bend during operation of the truck. The I-shaped sections are relatively more flexible than the box-like frame to accommodate or absorb the twist loads that are encountered while being rigid enough to resist the loads that can cause the bolster to bend.

8 Claims, 1 Drawing Sheet

BOLSTER OF A RAILROAD CAR TRUCK WITH VARYING CROSS-SECTIONAL SHAPE TO PROVIDE LESS TORSIONAL RIGIDITY AT ENDS

BACKGROUND OF THE INVENTION

The invention relates to railroad car trucks or bogies which are generally fabricated from a number of rigid metal parts, and especially to the bolsters which are connected between the sideframes of the trucks. More particularly, the invention relates to bolsters which are used in rigid H-type frames and Ladder-type frames which are employed in dual axle and triaxle trucks of heavy freight cars. It is important that the bolster and its end connections with the sideframes of such trucks be rigid to resist bending of the bolster under high vertical and longitudinal loads imparted to the bolster through the sideframes and resisted at the center of the bolster, as the truck moves along a railroad track. Incongruent as it may seem, the bolster ends connected to the sideframes should also be relatively flexible to accommodate twisting loads which are imparted to the bolster through the sideframes as the truck moves, for example, over wavy or uneven sections of railroad track. The invention is directed to the provision of a bolster which meets both of the requirements indicated above.

Briefly stated, the invention is in a bolster which has a generally hollow, box-like frame or construction which terminates short of the opposing bolster ends which are connected to the adjacent sideframes. This particular bolster construction is extremely rigid and able to resist the aforementioned bending stresses or loads which are highest at the center of the bolster. The box-like construction at each end of the bolster is transformed into a more flexible I-shaped section which is secured to an adjacent sideframe of the truck. The I-shaped section provides the necessary flexibility and rigidity to meet both of the loading conditions mentioned above.

DESCRIPTION OF THE DRAWING

The following description of the invention will be better understood by having reference to the accompanying drawing, wherein.

DETAILED DESCRIPTION OF THE DRAWING

Figure 1:
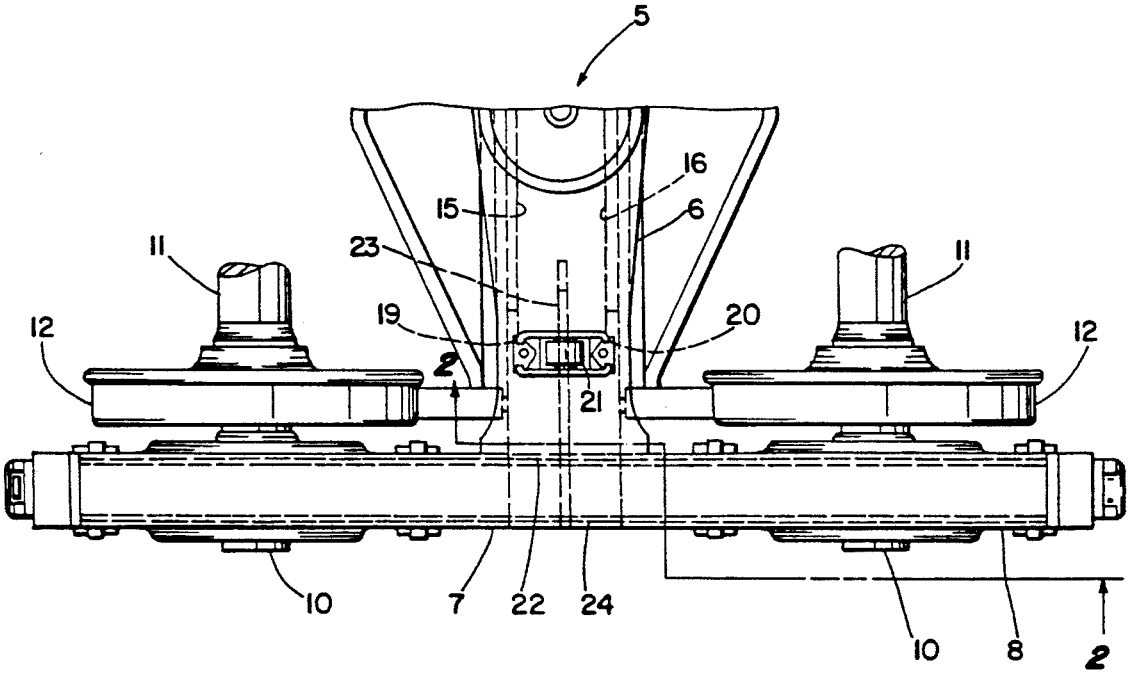
FIG. 1 is a plan view of one-half of a railroad car truck or bogie which is made in accordance with the invention.
Figure 2:
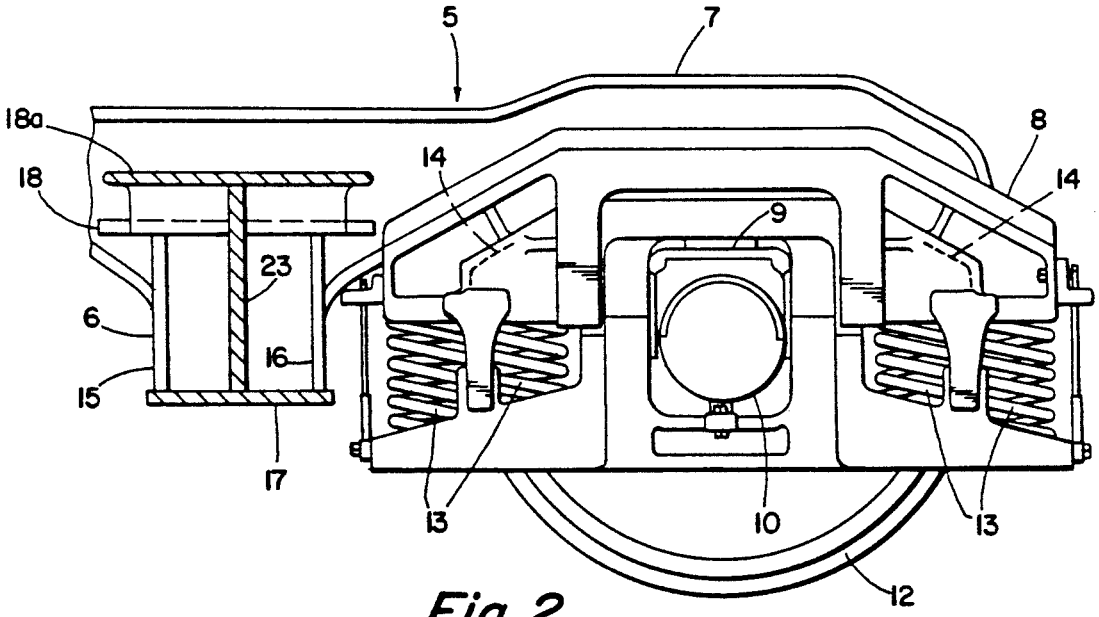
FIG. 2 is a section of the truck viewed from the line 2—2 of FIG. 1.

With reference to FIG. 1, there is shown one-half of a dual axle truck or bogie 5 which essentially comprises a bolster 6 which is secured transversely between a pair of similar, but oppositely disposed, parallel sideframes 7. Each of the sideframes 7 includes a pair of identical, but oppositely disposed pedestal frames 8 which are in end-to-end, aligned and spaced relation. Each of the pedestal frames 8, as best seen in FIG. 2, supports a journal saddle or axle box 9 with roller bearings in which one end 10 of an axle 11 with attached wheels 12 is mounted for rotation about the longitudinal axis of the axle 11. Each of the pedestal frames 8 also supports several assemblies of coil springs 13 and wedges 14 to help dampen undesirable motion imparted to the sideframes 7 via the wheels 12 and axles 11. This motion dampening mechanism is utilized in a railroad car truck that is manufactured and sold by National Castings Incorporated of Lisle, Ill. under the trademark AXLE MOTION II. This mechanism is described in greater detail in U.S. Pat. No. 3,517,620.

The bolster 6, as best seen in FIG. 2, is essentially comprised of four, rigid flat plates 15–18 which are welded together or integrally cast to form a hollow, box-like frame or construction. In either case, the two equidistant, parallel plates 15 and 16 are side plates which are secured between the bottom plate 17 and the top plate 18 which is parallel to, and wider than, the bottom plate 17. The side plates 15 and 16, as best seen in FIG. 1, each have a pair of opposing, free distal ends, e.g. ends 19 and 20, which terminate in predetermined spaced relation from the adjacent opposing ends of the bottom and top plates 17 and 18 and the connecting sideframes 7, where the bending stress is considerably less than the maximum bending stress at the center of the bolster 6. In practice, the side plates 15 and 16 terminate in the areas of the side bearings 21 which are carried by the bolster 6, adjacent the sideframes 7, to stabilize the position of the railroad car on the bolster 6. The opposing ends 18*a* of the top plate 18, beyond the distal ends 19 and 20 of the side plates 15 and 16, have a generally S-shape as they reversely curve upwardly away from the top plate 18 and opposing ends of the bottom plate 17 into engagement with at least the closest inboard sides 22 of the adjacent sideframes 7.

A pair of similar, flat web plates 23 are secured between each pair of opposing ends of the bottom and top plates 17 and 18 in parallel relation with the side plates 15 and 16, midway between the side plates 15 and 16 and parallel marginal edges of the bottom and top plates 17 and 18. Each of the web plates 23 extends from the inboard frame 22 of the adjacent sideframe 7 inwardly towards the center of the bolster 6 beyond the adjacent distal ends 19 and 20 of the side plates 15 and 16, where they terminate in overlapping relation with the side plates 15 and 16. Each of the web plates 23 forms an I-shaped section with the adjacent opposing ends of the wide bottom and top plates 17 and 18*a*. The I-shaped or wide flange sections which are secured to the sideframes 7 of the truck 5, are more flexible in response to the aforementioned twist loads than the more rigid box-like construction of the bolster 6 in the areas of the side plates 15 and 16, but are sufficiently rigid to resist the loads which tend to bend the bolster 6.

It can be appreciated that there are a number of different ways which the bolster 6 can be secured to the sideframes 7. For example, the opposing ends of the bottom and top plates 17 and 18*a* and connecting web plates 23, can be welded in abutting relation against the closest inboard sides 22, or they can be welded to both the inboard and outboard sides 22 and 24 of the adjacent sideframes 7, if a more rigid and stronger connection is desired.

Thus, there has been described a unique bolster which has a rigid box-like construction throughout most of its length to resist bending under high vertical and longitudinal loads experienced during operation, and less rigid I-shaped ends which are relatively flexible to twist loads which are also experienced during operation.

What is claimed is:

1. A bolster for connecting the sideframes of a railroad car truck, comprising:

a) a generally hollow, box-like construction between opposing ends of the bolster, the box-like construction having a cross-section which includes: a pair of parallel, flat side plates transversely connected to a flat bottom plate and a flat top plate which is parallel with the bottom plate which is in furthest spaced relation from a mechanism, carried by the bolster, for attachment to a railroad car, the top and bottom plates being coextensive with the length of the bolster which extends at least partially into the sideframes and the flat side plates being parallel throughout their length and having opposing ends which terminate in predetermined spaced relation from adjacent opposing ends of the top and bottom plates and sideframes the box-like construction of the bolster being rigid to resist loads which can cause the bolster to bend; and b) means integral with the bolster at least between each of the opposing ends of the top and bottom plates and the adjacent ends of the side plates for making the ends of the bolster more flexible than the box-like construction of the bolster, to loads which can cause the bolster to twist, while being rigid enough to resist the loads which can cause the bolster to bend.

2. A bolster for connecting the sideframes of a railroad car truck, comprising:

a) a generally hollow, box-like construction between opposing ends of the bolster, the box-like construction having a cross-section which includes: a pair of parallel, flat side plates transversely connected to a flat bottom plate and a flat top plate which is parallel with the bottom plate which is in furthest spaced relation from the mechanism, carried by the bolster, for attachment to a railroad car, the top and bottom plates being substantially coextensive with the length of the bolster, and the flat side plates having opposing ends which terminate in predetermined spaced relation from adjacent opposing ends of the top and bottom plates, the box-like construction of the bolster being rigid to resist loads which can cause the bolster to bend; and b) means integral with the bolster at least between each of the opposing ends of the top and bottom plates and the adjacent ends of the side plates for making the ends of the bolster more flexible than the box-like construction of the bolster, to loads which can cause the bolster to twist, while being rigid enough to resist the loads which can cause the bolster to bend, the means including a pair of flat web plates secured between the opposing ends of the top and bottom plates in parallel relation with the side plates and midway between the side plates, each of the web plates having a pair of opposing ends, the closest spaced opposing ends of the web plates being in overlapped relation with adjacent ends of the side plates.

3. The bolster of claim 2 in combination with a pair of sideframes to which adjacent ends of the top plate, bottom plate, and web plates are secured.

4. The bolster of claim 3 which includes a plurality of axles mounted between the pair of sideframes in parallel relation, each of the axles including a pair of wheels mounted on the axle for rotation about the longitudinal axis of the axle.

5. A railroad car truck, comprising:

a) a pair of sideframes on which a plurality of wheels are mounted for rotation about parallel axes which are normal to the planes of the sideframes;

b) a bolster secured between the sideframes in transverse relation thereto, the bolster having a pair of opposing ends and including:

c) means intermediate opposing ends of the bolster and terminating in predetermined spaced relation from the ends of the bolster and sideframes, to stiffen the bolster to resist loads which can cause the bolster to bend, the means including a bolster with a generally hollow, box-like construction which, in cross-section, comprises a pair of flat, parallel side plates secured at right angles to a flat top plate and a flat bottom plate which is parallel to the top plate which is closer to a mechanism that is carried by the bolster for attachment to a railroad car, the side plates having opposing ends which terminate in spaced relation from adjacent opposing ends of the top and bottom plates;

d) means between each of the opposing ends of the bolster and the bolster stiffening means for making the ends of the bolster relatively flexible to loads which can cause the bolster to twist while maintaining sufficient stiffness to resist the loads which can cause the bolster to bend, the means for making the bolster ends more flexible including a pair of similar, flat web plates secured between adjacent opposing ends of the top and bottom plates in parallel relation with the side plates midway between the side plates, each of the web plates extending from an adjacent sideframe inwardly towards each other and the center of the bolster, the closest spaced ends of the web plates being in overlapped relation with adjacent ends of the side plates; and e) means coacting between the bolster and sideframes for rigidly securing the opposing ends of the bolster to the sideframes.

6. The truck of claim 5, wherein the ends of the top plate, between the ends of the side plates and the sideframes, each have a generally S-shape as they reversely curve upwardly away from the top and bottom plates into contact with the sideframes.

7. The truck of claim 6, which includes three axles and attached wheels.

8. The truck of claim 6, which includes two axles and attached wheels.

* * * * *